United States Patent [19]

Viglione

[11] Patent Number: 5,056,198

[45] Date of Patent: Oct. 15, 1991

[54] PLANTER CLIP

[76] Inventor: Dean P. Viglione, Lot 31 Koala Way, Horsley Park, New South Wales 2164, Australia

[21] Appl. No.: 566,665

[22] Filed: Aug. 13, 1990

[30] Foreign Application Priority Data

Aug. 14, 1989 [AU] Australia ..... PJ5761

[51] Int. Cl.[5] ..... A47G 29/00; A44B 21/00

[52] U.S. Cl. ..... 24/336; 24/338; 47/67; 211/70.2; 248/229

[58] Field of Search ..... 24/336, 337, 338, 339, 24/265 C, 543, 562, 129 A; 47/67; 211/70.2; 248/229

[56] References Cited

U.S. PATENT DOCUMENTS

| | | | |
|---|---|---|---|
| 593,978 | 11/1897 | Boehm | 24/336 |
| 974,865 | 11/1910 | Dreher | 24/336 |
| 1,726,585 | 9/1929 | Propp | 24/336 |
| 2,637,475 | 5/1953 | Gialanella | 24/339 |
| 2,927,359 | 3/1960 | Thomas, Jr. | 24/562 |
| 2,996,329 | 8/1961 | Glazer | 24/339 |
| 3,212,743 | 10/1965 | Culver | 248/229 |
| 3,543,355 | 12/1970 | Wyckoff et al. | 211/70.2 |
| 4,083,457 | 4/1978 | Dromboski | 47/67 |
| 4,707,892 | 11/1987 | Nelson | 24/338 |
| 4,880,133 | 11/1989 | Cullinane | 47/67 |

*Primary Examiner*—Victor N. Sakran

*Attorney, Agent, or Firm*—Knobbe, Martens, Olson & Bear

[57] ABSTRACT

A planter clip is used to secure a plurality of pots containing plants together in order to prevent the pots tipping over in high winds. The planter clip comprises an elongate middle section having a clip on both ends. The clips are secured to the top rims of the pots and one clip is used to secure two adjacent pots together in a spaced arrangement. It is possible to secure a plurality of pots in a spaced grid pattern by using a plurality of such clips.

4 Claims, 4 Drawing Sheets

PLANTER CLIP

SUMMARY OF THE INVENTION

The present invention relates to growing plants in pots at nurseries, and in particular, to a planter clip which is used to secure the pots together to prevent the pots falling over in high winds.

In plant nurseries where it is the common practice to plant and grow yearlings and plants in pots, it is quite common for the plants and pots to be blown over in high winds. This is the particular case with regard to palm trees which have a large leaf area ratio to pot size and weight of the plant and pot. When the pots are blown over, as well as damaging the plants, it is a very time wasting procedure to right to pots and then ensuring that the soil in the pot is still in sufficient quantity.

It is an object of the present invention to provide a planter clip which clips the pots of pot plants together in order to prevent the toppling thereof.

According to one aspect of the present invention there is disclosed a planter clip apparatus comprising an elongate middle section with clip means at both ends thereof, wherein the clip means are able to be secured to the top rim of a pot thereby securing two pots together in a spaced arrangement.

According to another aspect of the present invention there is disclosed a method of securing pot plants in a grid pattern, including the steps of arranging the pot plants in a grid pattern and securing them in a spaced arrangement by a plurality of clips.

DETAILED DESCRIPTION OF THE DRAWINGS

Figure 1:
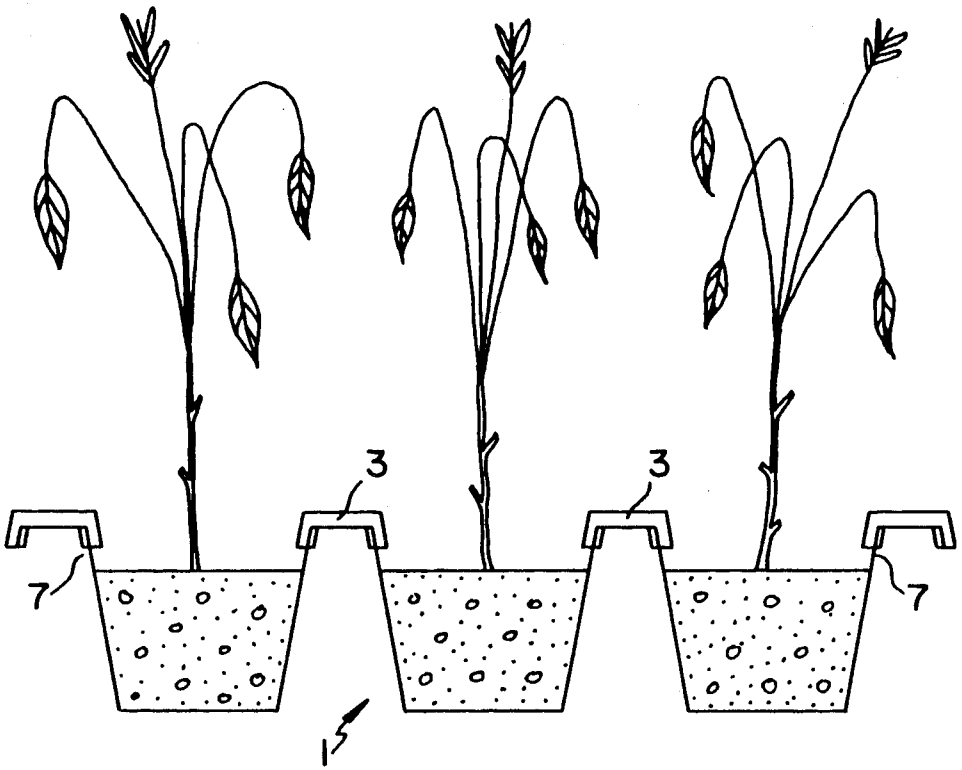
FIG. 1 is a side view of a plurality of pots which are clipped together according to the present invention.
Figure 2:
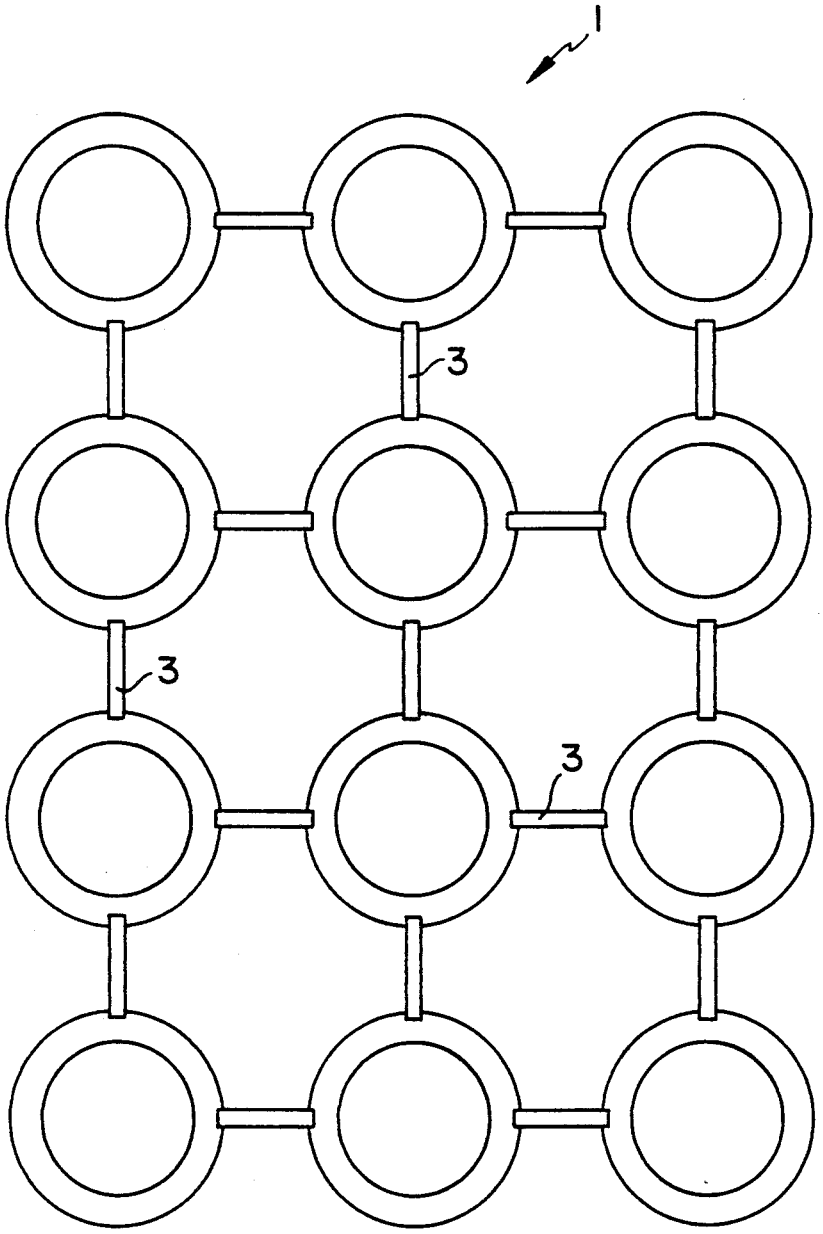
FIG. 2 is a plan view of a grid arrangement to be used with the present invention.
Figure 3:
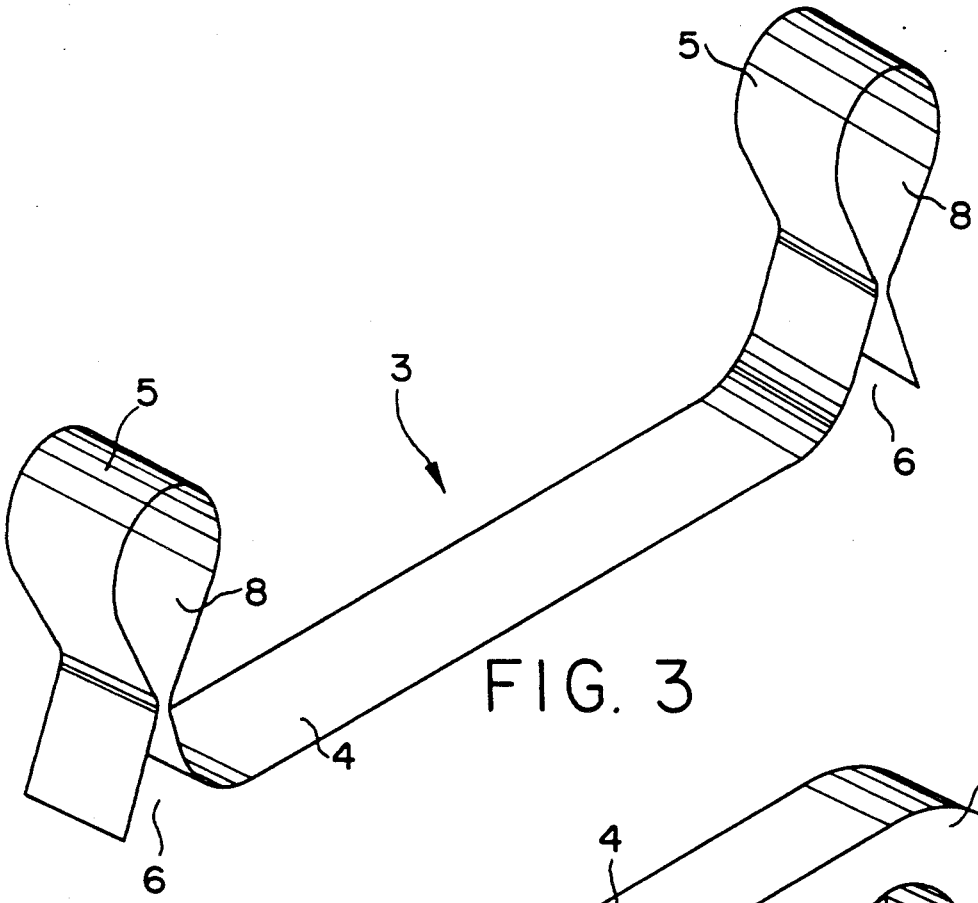
FIGS. 3 to 6 are perspective views of planter clips to be used in the present invention.
Figure 4:
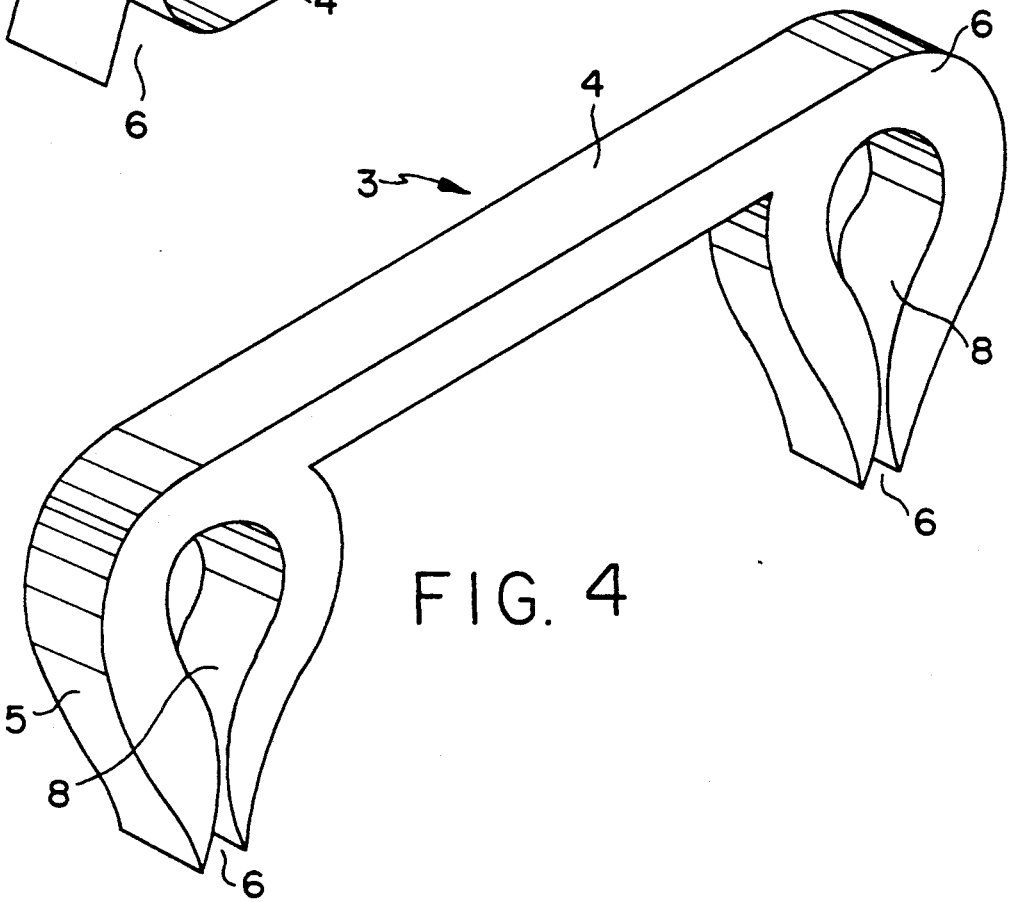
Figure 5:
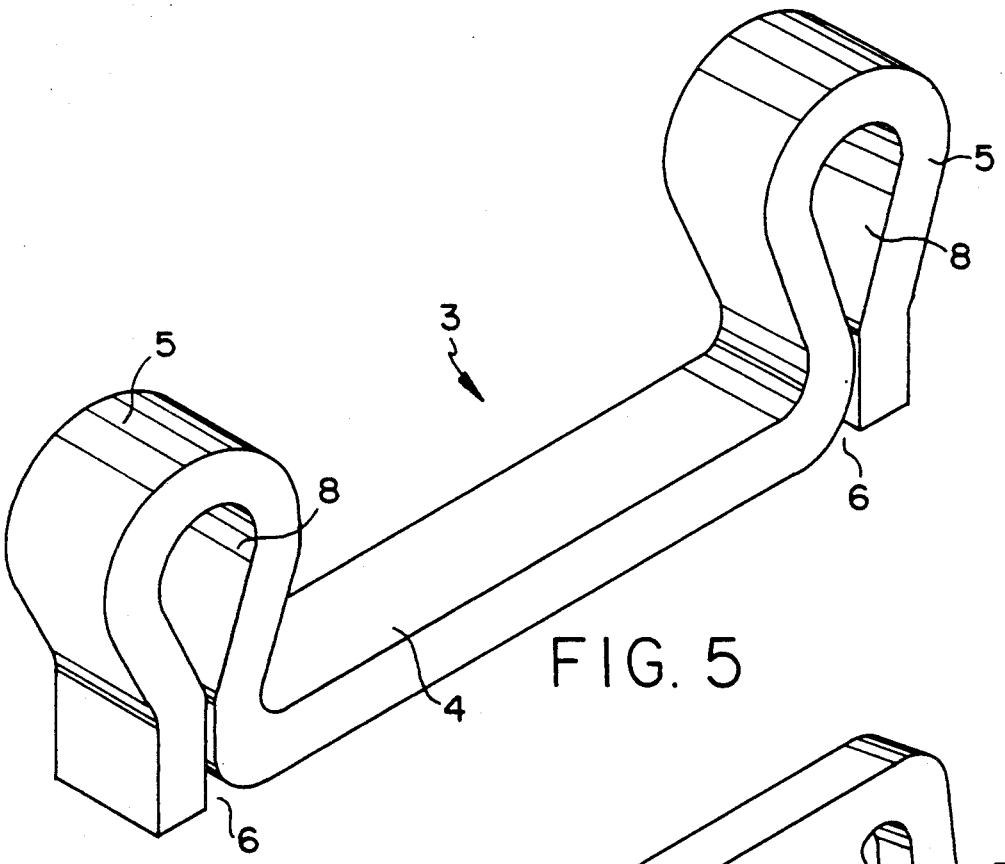

Illustrated in FIGS. 1 and 2 is an arrangement whereby a plurality of pots 1 are clipped together in a grid arrangement as in FIG. 2.

Illustrated in FIGS. 3 to 6 are different embodiments of the clip 3 of the present invention. The common factor in all the clips 3 is that there is an elongate middle section 4 and a clip arrangement 5 is able to be forced apart when being inserted over a rim of a pot 1. Once the clip arrangement 5 is in place over the rim 7 the springiness action of the clip arrangement 5 ensures that the clip 3 is secured in place.

The interior 8 of the clip arrangement 5 is so shaped in order that if the rim 7 of the pot 1 has a lip, such a lip is accommodated therein.

Figure 6:
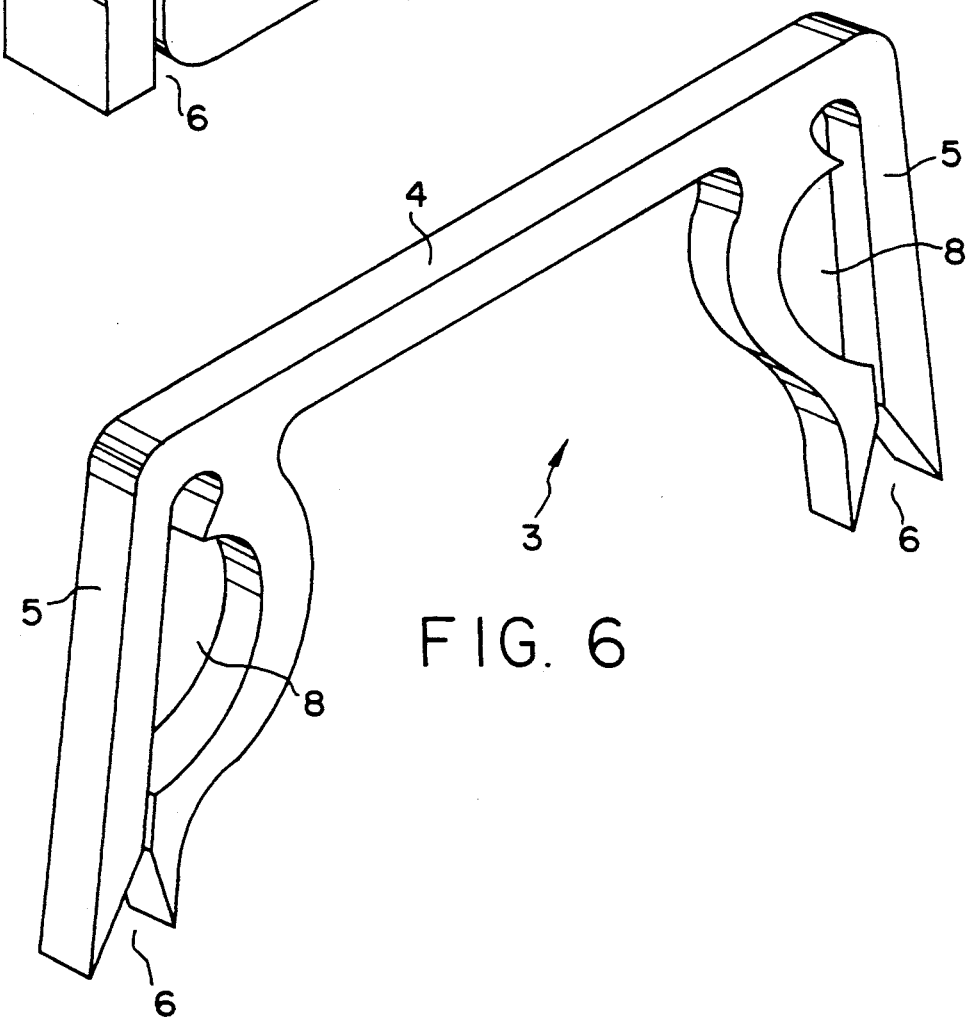

As seen in the embodiment of the clip 3 in FIG. 6, an extra space 9 by means of a protrusion is provided to lock such a lip if the lip exits.

As illustrated in FIGS. 1 and 2, it is possible to secure quite a number of pots 1 into a grid arrangement as illustrated. It is envisaged that there be a substantial number of pots or interconnected to provide a single mass thereby preventing any of the pots 1 from overturning.

The foregoing describes only some embodiments of the present invention, and modifications obvious to those skilled in the art can be made thereto without departing from the scope of the present invention.

For example, the clip of the present invention may have a number of clip arrangements 5, example 2, 3, 4, 5, etc. depending on the actual pattern of the grid planned. The clip 3 may be in a star pattern.

What is claimed is:

1. A planter clip apparatus comprising an elongate middle section having two ends with clip means at both ends thereof, wherein the clip means are able to be secured to the top rim of a pot thereby securing two different pots together in a spaced arrangement, wherein the apparatus is made from a flexible material and each said clip means comprises two flexible fingers which are biased towards each other such that a lip on each said pot is accommodated between said fingers, one of said fingers abutting an interior surface of the lip and the other finger abutting an exterior surface of the lip.

2. Apparatus according to claim 1 wherein said lip of pot is locked into position by a protrusion located on one of said fingers.

3. Apparatus according to claim 1 wherein a plurality of said planter clips are used to secure a plurality of pots in a grid pattern.

4. A method of securing a plurality of potted plants in a grid pattern, the pots of the potted plants secured by a planter clip having an elongate middle section supporting a clip at each of two ends, each clip having two biased fingers, the method comprising the steps of:

arranging the potted plants in a grid pattern;

selecting any two of the potted plants;

clipping one of the clips to one of the selected pots so that the distal finger contacts an interior surface of the one pot and the proximal finger contacts an exterior surface of the one pot;

clipping the other of the clips to the other of the selected pots so that the distal finger contacts an interior surface of the other pot and the proximal finger contacts an exterior surface of the other pot; and successively securing the pots in a spaced arrangement by a plurality of clips until all the pots are secured by at least one clip to the grid.

* * * * *